United States Patent [19]

Frayer et al.

[11] 4,170,546

[45] Oct. 9, 1979

[54] MULTISTAGE RESIDUAL OIL HYDRODESULFURIZATION PROCESS

[75] Inventors: James A. Frayer, Pittsburgh; Harry C. Stauffer, Cheswick; Stephen J. Yanik, Valencia, all of Pa.

[73] Assignee: Gulf Research and Development Company, Pittsburgh, Pa.

[21] Appl. No.: 843,876

[22] Filed: Oct. 20, 1977

[51] Int. Cl.[2] ..... C10G 23/02

[52] U.S. Cl. ..... 208/210

[58] Field of Search ..... 208/210, 89

[56] References Cited

U.S. PATENT DOCUMENTS

| | | | |
|---|---|---|---|
| 3,617,526 | 11/1971 | Coons, Jr. et al. | 208/210 |
| 3,663,434 | 5/1972 | Bridge | 208/210 |
| 3,968,026 | 7/1976 | Frayer et al. | 208/210 |
| 3,968,031 | 7/1976 | Frayer et al. | 208/210 |

*Primary Examiner*—George Crasanakis

[57] ABSTRACT

In the hydrodesulfurization of residual oil the amount of hydrogen consumed per atom of sulfur removed is relatively low until the desulfurization becomes deep, whereupon the amount of hydrogen consumed per atom of sulfur removed becomes relatively high. The present invention provides a multistage hydrodesulfurization process capable of producing products of low sulfur level while avoiding deep desulfurization of the heavy portion of the residual oil so that hydrogen consumption is diminished. The feed oil is fractionated to provide distillate and residual fractions. The residual fraction and hydrogen are charged to an upstream catalytic hydrodesulfurization stage. A portion of the upstream stage effluent stream is diverted from the process for use as refinery fuel and the remaining portion of the upstream stage effluent stream is charged to a downstream catalytic stage together with the feed distillate oil and hydrogen. The interstage diminution of the residual oil fraction provides a non-aliquot distillate-residual oil second stage feed stream which is relatively enriched in distillate oil. Since the sulfur in distillate oil is considerably less refractory than the sulfur in residual oil, the resulting dilution of the residual content of the downstream stage feed stream reduces hydrogen consumption by diminishing the depth of residual oil hydrodesulfurization required in the downstream stage to produce a low sulfur product.

6 Claims, 2 Drawing Figures

MULTISTAGE RESIDUAL OIL HYDRODESULFURIZATION PROCESS

Figure 1:
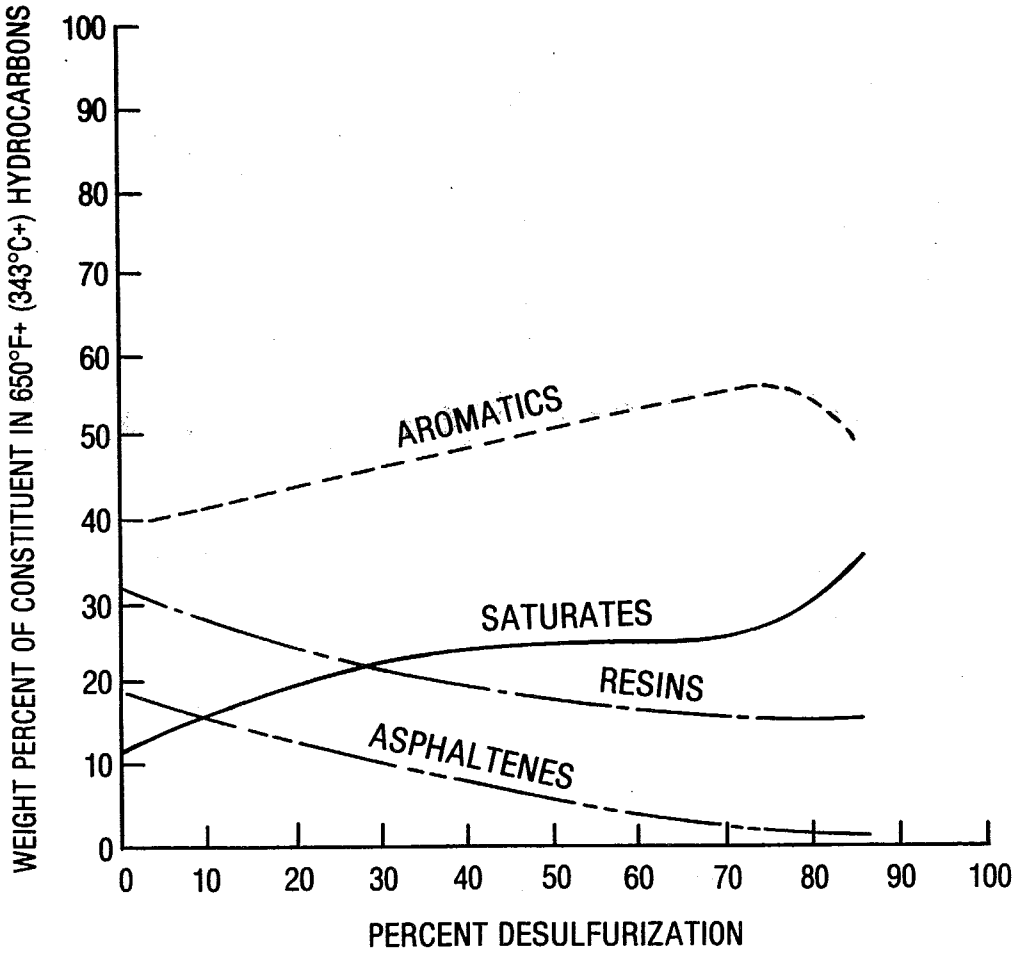

This invention relates to a multistage process for the catalytic hydrodesulfurization of residual oils containing metals, sulfur and asphaltenes.

When residual oils, such as petroleum residuals, are desulfurized in the presence of molecular hydrogen, the hydrogen consumption economy of the desulfurization reaction decreases as the depth of sulfur removal increases. For example, in the catalytic hydrodesulfurization of a 650° F.+ (343° C.+) Kuwait reduced crude oil containing 4 weight percent sulfur, it was found that removal of 3 of the 4 weight percent sulfur present in the oil to reduce the sulfur contant of the oil to 1 weight percent requires a hydrogen consumption of about 500 standard cubic feet per barrel (9 SCM/100 L), providing a hydrogen efficiency of 167 standard cubic feet of hydrogen (4.68 $M^3$) per percent of sulfur in the oil which is removed. The removal of the next 0.7 weight percent increment to reduce the sulfur content of the oil to 0.3 weight percent requires a hydrogen consumption of 165 standard cubic feet per barrel (2.97 SCM/100 L), providing a hydrogen efficiency of 236 standard cubic feet of hydrogen (6.61 $M^3$) per percent of sulfur in the oil which is removed. Finally, the removal of an additional 0.2 weight percent sulfur increment to reduce the sulfur content of the oil to 0.1 weight percent requires a hydrogen consumption of 170 standard cubic feet per barrel (3.07 SCM/100 L), providing a hydrogen efficiency of 850 standard cubic feet of hydrogen (23.8 $M^3$) per percent of sulfur in the oil which is removed. These data show that with removal of progressively deeper increments of sulfur from the residual oil the hydrosulfurization process becomes progressively hydrogen inefficient as evidenced by the fact that removal of the final 0.2 weight percent increment of sulfur in the oil requires about 5 times the hydrogen consumption per atom of sulfur removed as compared to the hydrogen consumption during the removal of the first 3 weight percent increment of sulfur in the oil.

We have now discovered a method for the multistage desulfurization of residual oil which provides a desulfurized product having a relatively low sulfur level while avoiding deep, hydrogen inefficient hydrodesulfurization of the heavy portion of the residual oil. The present invention involves a series multi-stage hydrodesulfurization operation including removal of a concentrated high boiling residual oil split between upstream and downstream stages. At the same time, a concentrated distillate fraction is charged to the downstream stage independently of the residual fraction. Thereby, the stream entering the downstream stage contains a non-aliquot proportion of distillate and residual components since it is impoverished or depleted of residual components although it contains most or all of the distillate components of the feed oil to the hydrodesulfurization process. Since the sulfur in the distillate oil is relatively non-refractory, the dilution of residual components with distillate oil relieves the second stage of the necessity of accomplishing extremely deep desulfurization of refractory residual components in order to produce a low sulfur effluent stream.

In accordance with the present invention, crude or reduced crude oil containing substantially all of the asphaltenes of the full crude is distilled to prepare separate distillate and residual oil fractions for hydrodesulfurization. The residual fraction is passed to a first or upstream hydrodesulfurization stage while the distillate fraction by-passes the upstream stage and is passed directly to a second or downstream stage. A portion of the residual oil fraction is removed between the stages, and the greater the amount of distillate oil removed at the feed distillation column the more concentrated in residual components will be the oil removed between the stages and the greater will be the dilution of the non-removed residual components when blended with the distillate fraction in the downstream stage. An amount ranging between about 10, 20 or 30 up to 50, 65 or 75 weight percent of the essentially full range normally liquid material in the residual interstage stream is removed from the process.

The present invention has particular utility where the concentrated residue removed from the process between the hydrodesulfurization stages is utilized as a refinery fuel. The permissible sulfur levels for fuels employed in a refinery are generally higher than for fuels prepared for general commercial consumption. In the event that the sulfur level of the removed residue exceeds the maximum permissible level for refinery use, the removed residue can be blended with one or more relatively low sulfur, low value streams available in a refinery, such as cycle oil or decanted oil. The availability of these low sulfur, low value streams in a refinery contributes to the utility of the removed residue as refinery fuel.

Figure 2:
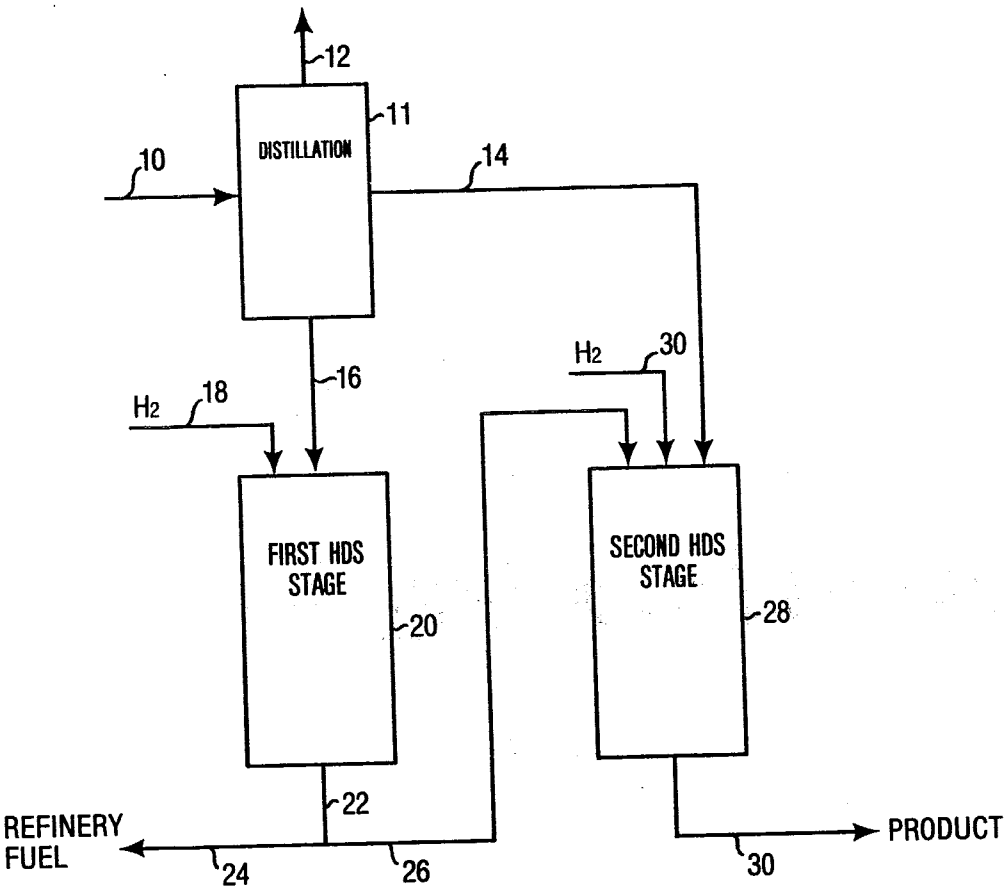

The present invention is illustrated in FIGS. 1 and 2, wherein FIG. 1 shows the proportion of aromatics, saturates, resins and asphaltenes in a residual oil as the oil experiences progressive hydrodesulfurization, and FIG. 2 shows a process scheme for performing this invention.

The decrease in the hydrodesulfurization duty of the process resulting from an increase in the aliquot ratio of distillate to residue components in the stream being treated is illustrated by the data of Table 1. Table 1 shows the volume percent of various boiling range fractions and the sulfur content of each fraction in a hydrodesulfurization effluent stream containing 0.15 weight percent sulfur obtained by hydrodesulfurization of a 650° F.+ (343° C.+) Kuwait residual oil containing 4 weight percent sulfur.

TABLE 1

| TBP Fraction | Vol. % of Total Yield | Wt. % Sulfur in Fraction | % of Total Sulfur in Product |
|---|---|---|---|
| IBP-375° F. (IBP-191° C.) | 1.62 | 0.04 | 0.38 |
| 375°-650° F.(191°-343° C.) | 13.71 | 0.04 | 3.50 |
| 650°-1065° F. (343°-574° C.) | 68.11 | 0.09 | 40.84 |
| 1,065° F. + (574° C.+) | 16.56 | 0.47 | 55.28 |

Table 1 shows that more than half of the total sulfur in the product is contained in the highest boiling 16.56 volume percent fraction of the total yield, which is the 1065°F.+ (574° C.+) fraction. Therefore, if half of the 1065° F.+ (574° C.+) product fraction could be utilized as refinery fuel, removal of this segment would constitute removal of only about 8 volume percent of the stream but would accomplish removal of about 23 weight percent of the total sulfur in the stream. It is seen that removal of a relatively small volumetric portion of the total stream, when the removed portion is a concentrated residue fraction, substantially diminishes the sulfur concentration in a remaining non-aliquot distillate-residue stream. The method of this invention thereby greatly reduces the depth of hydrodesulfurization required to produce an ultimate product having a low sulfur level. In this manner, a product having a low sulfur level can be produced with a relatively high hydrogen efficiency.

The data of Table 1 indicate that the most refractory sulfur in a residual oil is concentrated in the highest boiling fraction, which is the asphaltene-containing fraction. Asphaltenes are non-distillable. However, some of the non-distillable asphaltenes in the feed are upgraded to distillate material via hydrodesulfurization in the first stage, leaving the most refractory asphaltenes in the first stage effluent. This is illustrated by FIG. 1, herein, which was also presented in U.S. Pat. No. 3,761,399, and which shows the proportions of aromatics, saturates, resins and asphaltenes in a 650° F.+ (343° C.+) residual oil as the oil experiences progressive catalytic hydrodesulfurization. The resins and asphaltenes comprise the residue of a propane extraction of the oil. Resins and asphaltenes are subsequently separable by a pentane extraction since resins are soluble in pentane while asphaltenes are not. As shown in FIG. 1, the resin and asphaltene content of the oil steadily decreases with increasing hydrodesulfurization. This decrease is due to the severing of carbon-sulfur bonds, thereby breaking off molecular fragments. The accumulation of these molecular fragments is reflected in FIG. 1 by the indicated build-up of lower molecular weight saturates and aromatics. When the desulfurization level reaches about 75 percent, the resin and asphaltene content of the oil becomes stable, indicating little additional severing of molecular fragments therein. At the same time, the total aromatics and saturates content also tends to stabilize, with any increase in saturates level being accompanied by a decrease in aromatics level. This indicates that after about 75 percent desulfurization the process tends to consume hydrogen by hydrogenation of aromatics, which represents a fruitless consumption of hydrogen.

It has been observed in conventional residual oil hydrodesulfurization processes which produce a very low sulfur residual oil product, requiring more than about 90 or 95 weight percent desulfurization, the unconverted asphaltenic material in the product becomes highly incompatible with the lower boiling oils and tends to settle out of solution. This incompatibility may arise because the hydrogen consumed during deep desulfurization is selectively acquired by the lower boiling oils, as indicated by the increase in saturates level in FIG. 1, while refractory asphaltenes are impervious to hydrogenation, thereby inducing a widened differential in the hydrogen to carbon ratios of the unconverted asphaltenes and the hydrogenated oils. The removal of a portion of a concentrated stream of asphaltenes from the process reduces the level of hydrogenation required to produce a low sulfur product so that the stability of the refractory asphaltenes remaining in the hydrodesulfurized oil tends to be improved.

FIG. 1 shows that a substantial portion of the feed asphaltenes (the general term "asphaltenes" as used herein includes both asphaltenes and resins, since both are non-distillable materials) can be converted to saturates and aromatics in an upstream hydrodesulfurization stage. The demonstration in FIG. 1 that a substantial portion of the feed asphaltenes can be converted in an upstream hydrodesulfurization stage is the reason that a portion of the asphaltenes is not removed directly from the feed oil in the process of the present invention. By removing asphaltenes from an upstream stage effluent stream rather than directly from the feed oil, the asphaltene removal is selective towards refractory asphaltenes. The demonstration in FIG. 1 that an attempt to convert the refractory asphaltenes is extremely difficult and results in a wasteful consumption of hydrogen, as evidenced by a conversion of aromatics to saturates, is the reason that a portion of the refractory asphaltenes is removed in advance of the downstream stage.

Data were also presented in U.S. Pat. No. 3,761,399 showing that in a non-desulfurized residual oil the sulfur concentration in the various fractions are relatively uniform and that it is in the course of the hydrodesulfurization operation that the highest sulfur concentration devolves to the high boiling refractory asphaltene fraction. Table 2 shows the progressive changes in sulfur concentration occurring in various fractions during two stage catalytic hydrodesulfurization of a reduced crude oil containing 4.09 weight percent sulfur. The 650° F.+ (343° C.+) product of the first stage had a sulfur content of 1.09 weight percent while the corresponding second stage effluent oil contained 0.58 weight percent sulfur.

TABLE 2

| | Feed to first stage (4.09 wt. % sulfur) | | Feed to second stage (1.09 wt. % sulfur) | | Product from second stage (0.58 wt. % sulfur) | |
|---|---|---|---|---|---|---|
| Percent by wt.: | Fraction | Sulfur in Fraction | Fraction | Sulfur in Fraction | Fraction | Sulfur in Fraction |
| Saturates | 17.98 | 3.42 | 22.24 | 0.80 | 22.34 | 0.49 |
| Aromatics | 55.45 | 5.04 | 60.45 | 1.12 | 61.91 | 0.56 |
| Resins | 16.73 | 5.59 | 13.76 | 2.37 | 12.72 | 1.56 |
| Asphaltenes | 9.84 | 6.99 | 3.55 | 4.95 | 3.03 | 3.13 |

Table 2 shows that the sulfur levels in the various fractions of the feed oil are relatively uniform. However, during passage of the feed oil through the first hydrodesulfurization stage the saturates and aromatics lose sulfur to the greatest extent, while the resins and asphaltenes lose sulfur to the least extent. The same occurs during second stage hydrodesulfurization.

Table 3 contains data from U.S. Pat. No. 3,761,399 which show the effect of catalytic hydrodesulfurization upon the boiling range of a residual oil. In the tests of Table 3, the reduced crude was hydrodesulfurized in three stages.

TABLE 3

| | Feedstock | Effluent from each of three desulfurization stages | | |
|---|---|---|---|---|
| Sulfur, percent by wt. | 5.43 | 4.77 | 1.41 | 0.83 |
| Boiling range, °F. | 566–1,400+ | 514–1,400+ | 509–1,400+ | 466–1,400+ |

TABLE 3-continued

| | Feedstock | Effluent from each of three desulfurization stages | | |
|---|---|---|---|---|
| | (297°-560° C. +) | (268°-560° C. +) | (265°-560° C. +) | (241°-560° C. +) |
| Desulfurization, percent | — | 12.2 | 74.0 | 85.0 |

The data of Table 3 show that while the first 74 percent of the sulfur in the oil was being removed, the IBP of the oil was reduced from 566° to 509° F. (297° to 265° C.), or 57° F. (32° C.), while the attempt to reduce the sulfur content only slightly further to achieve 85 percent desulfurization induced reduction of the IBP to 466° F. (241° C.), or an additional 43° F. (24° C.). These data show that the first 74 percent desulfurization has a relatively small effect upon boiling point reduction, while the removal of the more refractory sulfur has a greater effect upon boiling point reduction. It is a significant feature of the present invention that since desulfurization is achieved in part by a dilution effect in place of deep hydrodesulfurization, the process of the present invention can diminish even the small amount of boiling point reduction shown in the above table, thereby reducing hydrogen consumption.

The catalyst of the first stage of a multi-stage residual oil hydrodesulfurization system is not greatly deactivated by coking because relatively reactive asphaltenes are available for conversion in the first stage. In multistage residual oil hydrodesulfurization processes, most of the sulfur is removed in the first stage. For example, the first stage generally removes 60, 70, 75 or more weight percent of the sulfur content in the feed oil. However, the more refractory asphaltenes pass unconverted through the first stage and it is the sulfur in these refractory asphaltenes that conventionally must be removed in second or third hydrodesulfurization stages. Unfortunately, refractory asphaltenes are known coke formers and the removal of sulfur therefrom in a downstream stage is conducive to coke formation. Therefore, in conventional multistage hydrodesulfurization operations, while coke formation is not significant in the first stage, the second stage catalyst is generally deactivated by coke, and the deactivation of the second stage catalyst generally occurs more rapidly than the deactivation of the first stage catalyst. The coke problem in a second or third stage is the reason for the use of a specialized coke-resistant catalyst in downstream stages, such as the Group IV-B metal-promoted coke resistant second stage catalyst utilized in the process of U.S. Pat. No. 3,968,027.

The amount of coking in a second or subsequent hydrodesulfurization stage generally increases with the concentration of refractory asphaltenes in the oil stream flowing through those stages. Downstream hydrodesulfurization catalysts tend to induce coking via agglomeration and polymerization of refractory asphaltene molecules. These reactions occur because desulfurization catalysts are hydrogenation-dehydrogenation agents and since the asphaltenes in the downstream stage are refractory to hydrodesulfurization their residence time at the surface of the catalyst is extended, blocking access of hydrogen to the catalyst, and it is this inaccessibility of hydrogen which induces dehydrogenation and ultimately coking. Any increase in the concentration of refractory asphaltenes tends to increase the incidence of agglomeration and polymerization so that, conversely, in accordance with the present invention, the amount of coking in the second stage is reduced via removal of a portion of the refractory asphaltenes between the stages and by dilution of the non-removed asphaltenes prior to their entry into the second stage. The removal of a segment of the concentrated asphaltene stream flowing from the first stage in accordance with this invention constitutes selective removal of the most refractory molecules in the system. Dilution of the non-removed asphaltenes with non-desulfurized distillate oil shifts the desulfurization duty of the catalyst in second and subsequent stages from the refractory heteroatom sulfur embedded within polycondensed aromatic rings of asphaltenic molecules to the more reactive thiophenic sulfur in distillate molecules.

The stream flowing through the second stage comprises a non-aliquot ratio of distillate to residual components since it contains most or all of the distillate components of the feed stream but has been deprived of a portion of the asphaltenic components. The diminished quantity of refractory asphaltenes entering the second stage will have the benefit of the dilution and viscosity reducing effects of most or all of the distillate portion of the feed oil. It was shown in U.S. Pat. No. 3,761,399 that the rate of hydrodesulfurization of a residual fraction can be improved by diluting the residual fraction with highly desulfurized gas oil, probably due to solubilizing of viscous, high molecular weight sulfur-containing molecules and improving their mass transfer in the system. That patent further showed that excessive dilution of a residual fraction with highly desulfurized gas oil can inhibit the rate of desulfurization of the residual fraction, probably due to excessive dispersal of the sulfur-containing molecules. However, the present invention tends to circumvent the problem of a diminished rate of second stage residual oil desulfurization. This invention permits a relaxation of dependence upon deep desulfurizaion of the residual fraction by practicing the interdependent operations of selective removal from the process of a concentrated stream of sulfur-refractory residual components and dilution of the non-removed residual components with the distillate portion of the feed oil, so that the oil flowing through the downstream stage comprises a non-aliquot mixture of residual and distillate components, as compared to the feed oil. In this manner, in a downstream stage the quantity of the most sulfur-refractory material in the feed oil is diminished concomitantly with an increase in the concentration of the most sulfur-reactive material in the feed, releasing the process from the burden of accomplishing a deep desulfurization of residual components in order to achieve a low sulfur product.

Since the refractory asphaltenes removed between the stages is the material which would have contributed most heavily to coking in the downstream stage, the total liquid yield of the process is enhanced by avoiding conversion of liquid material to coke. This advantageous yield effect provides a concomitant advantageous catalyst aging effect since diminution of coke formation in the downstream stage tends to extend the active life of the second stage catalyst.

The present invention relates to a plural stage process for the hydrodesulfurization of an asphaltene-containing residual oil in which at least two different streams of hydrodesulfurized residual oil are removed from the process with each removed stream having a different sulfur content and boiling range as it is separated from the process, without any product blending or product distillation step being required to accomplish these differences. One of the product residual oil streams has a narrow boiling range and a relatively high sulfur level while the other product residual oil stream has a wider boiling range and a relatively low sulfur level. The low sulfur residual oil stream is the primary product of the process and meets the demanding sulfur specifications for commercial fuels to be burned in densely populated areas. The relatively high sulfur level residual oil product has a higher average boiling point and meets the less demanding specifications for refinery fuels. As noted above, refinery fuels can utilize high sulfur streams because of the availability in refineries of low quality but low sulfur streams for blending, such as cycle oil or decanted oil. Removal of the refinery fuel stream in the process of this invention avoids overtreating of that portion of the total stream, relative to its intended use, resulting in a significant savings in hydrogen, in extended catalyst life and in increased liquid yield in the process. The increased liquid yield results from reduced conversion to coke.

The hydrodesulfurization catalyst of all of the stages of the present process comprises at least one Group VI metal and at least one Group VIII metal on a non-cracking support. Suitable Group VI and Group VIII metal combinations include cobalt-molybdenum, nickel-tungsten and nickel-molybdenum. A preferred combination is nickel-cobalt-molybdenum. The catalyst support comprises a highly porous, non-cracking supporting material. Alumina is the preferred supporting material, but other porous, non-cracking supports can be employed, such as silica-alumina and silica-magnesia.

The catalyst in any downstream stage can be the same as or different from the catalyst employed in the first stage. For example, the proportions of catalytic metals can be the same or can be different. The composition of the downstream catalyst can be generally the same as the composition of the first stage catalyst except that it can contain a promoting amount of a Group IV-B metal, such as titanium, zirconium or hafnium, preferably titanium. Promotion with a Group IV-B metal improves the resistance of the downstream catalyst to coking. However, removal of a portion of the refractory asphaltene stream in advance of the downstream stage in accordance with this invention diminishes the need for a cokeresistant downstream catalyst.

In the present process, the oil is passed downwardly through a fixed bed of catalyst in each stage. A portion of the feed oil is passed through the upstream reactor only, another portion is passed through a downstream reactor only, and still another portion is passed through both stages. Very little hydrocracking occurs in the process. In general, at least 40 or 50 weight percent of the total hydrodesulfurization product boils above the IBP of the hydrodesulfurization feed oil and, preferably, at least 70, 80 or 90 weight percent of the hydrodesulfurization product boils above the IBP of the hydrodesulfurization feed oil. The hydrodesulfurization temperature should be sufficiently low that not more than 30 percent, generally, and preferably not more than about 20, 15 or even 10 percent of the 650° F.+ (343° C.+) feed oil will be converted to material boiling below 650° F. (343° C.).

The hydrodesulfurization process of this invention employs in each stage a hydrogen partial pressure of 500 to 5,000 pounds per square inch (35 to 350 kg/cm$^2$), generally, 1,000 to 3,000 pounds per square inch (70 to 210 kg/cm$^2$), preferably, and 1,500 to 3,000 pounds per square inch (105 to 175 kg/cm$^2$), most preferably. The gas circulation rate in each stage can be between 1,000 and 20,000 standard cubic feet per barrel (17.8 and 356 SCM/100 L), generally, or preferably about 2,000 to 10,000 standard cubic feet per barrel (35.6 to 178 SCM/100 L). The gas circulated preferably contains 85 percent, or more, of hydrogen. The mol ratio of hydrogen to oil in each stage can be between about 4:1 and 80:1. Reactor temperatures can vary between about 600° and 900° F. (316° and 427° C.), generally, and between about 650° and 800° F. (343° and 427° C.), preferably. Reactor temperatures are increased in each stage during a catalyst cycle to compensate for activity loss due to aging. The liquid hourly space velocity in each reactor can be between about 0.1 and 10, generally, and between about 0.2 and 1 or 2, preferably.

The process can be used for desulfurizing asphaltene-containing oils other than petroleum oils, such as coal liquids and oils extracted from shale and tar sands. Asphaltenes have a relatively low hydrogen to carbon ratio and will generally comprise less than half of the feed oil, but will generally contain most of the metallic components present in the total feed, such as nickel and vanadium.

A process scheme for performing the present invention is shown in FIG. 2. As shown in FIG. 2, a crude or reduced crude oil is charged through line 10 to distillation column 11. Distillation column 11 discharges a light oil stream through overhead line 12 and separates a distillate oil stream which passes through line 14 from a residual oil stream which passes through line 16. The distillate oil stream in line 14 can be a 375° to 650° F. (191° to 343° C.) fraction, a 375° to 800° F. (191° to 427° C.) fraction, a 650° to 800° F. (343° to 427° C.) fraction, or a fraction of any other desired boiling range. The residual stream in line 16 can comprise a 650° F.+ (343° C.+) stream, an 800° F.+ (427° C.+) stream or a residue oil having any other desired IBP. The residue in line 16 together with hydrogen entering through line 18 is passed downwardly through first catalytic hydrodesulfurization stage 20 wherein the residue is desulfurized to produce a first stage effluent stream which is removed through line 22. A portion of the residual oil in line 22 comprising at least 5 percent of the stream in line 22 is split out of the process through line 24 for any desired purpose, such as for use as refinery fuel. If desired, the stream in line 24 can be blended with another refinery stream having a lower sulfur content, such as a decanted oil stream or a cycle oil stream.

The remaining portion of the first stage effluent stream from line 22 is passed through line 26 to second catalytic hydrodesulfurization stage 28 together with a hydrogen stream passing through line 30. The distillate oil in line 14 is also passed to second hydrodesulfurization stage 28 and a low sulfur hydrodesulfurization oil stream is recovered from the bottom of stage 28 through line 30. The stream in line 30 constitutes the primary product of the process and contains a non-aliquot proportion of distillate to residual components, being impoverished in residual components by the amount of the residual stream removed through line 24.

We claim:

1. A process for the hydrodesulfurization of an aromatics- and asphaltene-containing feed oil to produce at least two hydrodesulfurized residual oil streams having different respective asphaltene and sulfur contents, said process employing upstream and downstream hydrodesulfurization stages containing hydrodesulfurization catalyst comprising Group VI and Group VIII metal on a non-cracking support at a temperature between 600° and 900° F. and a hydrogen pressure between 500 and 5,000 psi, said process comprising fractionating said feed oil into an asphaltene-containing residual oil and a distillate oil, passing said residual oil and hydrogen through said upstream hydrodesulfurization stage and recovering an upstream stage effluent stream containing refractory sulfur asphaltenes, said distillate oil by-passing said upstream stage and passed directly to said downstream stage, splitting said upstream stage effluent stream into a first effluent portion comprising between about 10 and 75 weight percent of the normally liquid material in said upstream stage effluent stream and a second effluent portion, removing said first effluent portion from said process to selectively remove refractory sulfur asphaltenes from said process and to increase the concentration of more sulfur-reactive material in said downstream stage, passing said second effluent portion together with said distillate oil and hydrogen through said downstream stage, and recovering a downstream stage effluent stream, said downstream stage effluent stream containing aromatics and having a sulfur concentration which is at least 75 percent lower than the sulfur concentration of said feed oil, the removal of said first effluent portion allowing the sulfur concentration in said downstream effluent stream to be achieved with a relatively high aromatics concentration as compared to the aromatics concentration when achieving the same sulfur concentration by hydrodesulfurization without selective removal of refractory sulfur asphaltenes.

2. The process of claim 1 wherein said first effluent portion comprises between about 30 and 50 weight percent of the normally liquid material in said upstream stage effluent stream.

3. The process of claim 1 wherein said first effluent portion comprises between about 20 and 65 weight percent of the normally liquid material in said upstream stage effluent stream.

4. The process of claim 1 wherein not more than 10 percent of said feed oil boiling above 650° F. is converted to material boiling below 650° F.

5. The process of claim 1 wherein not more than 30 percent of said feed oil boiling above 650° F. is converted to material boiling below 650° F.

6. The process of claim 1 wherein the downstream hydrodesulfurization stage catalyst includes a promoting amount of Group IV-B metal.

* * * * *